US005252909A

United States Patent [19]

Aizaki

[11] Patent Number: 5,252,909

[45] Date of Patent: Oct. 12, 1993

[54] CONSTANT-VOLTAGE GENERATING CIRCUIT

[75] Inventor: Shingo Aizaki, Kanagawa, Japan

[73] Assignee: NEC Corporation, Tokyo, Japan

[21] Appl. No.: 824,063

[22] Filed: Jan. 23, 1992

[30] Foreign Application Priority Data

Jan. 25, 1991 [JP] Japan ..... 3-025507

[51] Int. Cl.[5] ..... G05F 3/16

[52] U.S. Cl. ..... 323/313; 307/296.1

[58] Field of Search ..... 323/313, 314, 315, 316; 307/296.1

[56] References Cited

U.S. PATENT DOCUMENTS 3,932,768 1/1976 Takahashi et al. ..... 307/237
5,030,903 6/1991 Bernard et al. ..... 323/313
5,132,936 7/1992 Keswick et al. ..... 365/189.06

*Primary Examiner*—Emanuel T. Voeltz
*Assistant Examiner*—Ben M. Davidson
*Attorney, Agent, or Firm*—Laff, Whitesel, Conte & Saret

[57] ABSTRACT

In a constant-voltage generating circuit wherein a first series circuit of PMOS transistors, a second series circuit of a PMOS transistor and an NMOS transistor and a third series circuit of PMOS transistors are connected between a power source line and a ground line, a capacitive element is connected between a common node of the PMOS transistors of the first series circuit and the ground line. In addition to this capacitive element, another capacitive element may be connected between the node and the power source line. Since the node is connected to gates of one of the PMOS transistors of the first series circuit and the PMOS transistor of the second series circuit, the capacitance at this node with respect to the power source line is large. Thus, when the power supply voltage fluctuates abruptly, the voltage at the first node also changes and thus the output voltage also changes. This phenomenon can be suppressed by the action of the capacitive element connected between the common junction node of the first series circuit and the ground line.

8 Claims, 2 Drawing Sheets

CONSTANT-VOLTAGE GENERATING CIRCUIT

BACKGROUND OF THE INVENTION (1) Field of the Invention:

The present invention relates to a constant-voltage generating circuit and, more particularly, to a constant-voltage generating circuit which is used such as in an internal voltage dropping circuit (step-down circuit) in a MOS memory circuit.

(2) Description of the Related Art:

First, an explanation will be given on the circuit and the operation of an internal voltage dropping circuit provided with a prior art constant-voltage generating circuit. FIG. 1 is a circuit diagram of the prior art constant-voltage generating circuit and FIG. 2 is a chart showing voltage dependencies with respect to power supply voltages at internal nodes.

In FIG. 1, symbols $Q_P1$ through $Q_P5$ each denotes a P-channel MOS field effect transistor (hereinafter simply referred to as a "PMOS"); $Q_N1$ denotes an N-channel MOS field effect transistor (hereinafter referred to as an "NMOS"); N1, N2 each denotes an internal node; and $V_{REF}$ denotes a constant-voltage output node. It should be noted that the PMOSs $Q_P2$ and $Q_P3$ have a higher current capability than that of the PMOS $Q_P1$ and the NMOS $Q_N1$. In the following explanation, a power supply voltage is represented by $V_{CC}$, and an absolute voltage of threshold voltage of a PMOS transistor is represented by $V_{TP}$.

Here, an explanation will be made as to how the potentials at the internal nodes N1, N2 and further at the output node $V_{REF}$ are determined.

The NMOS $Q_N1$ is always in a conductive state (on-state) since the gate potential thereof is at the power supply voltage $V_{CC}$. Therefore, the potential at the node N2 falls towards a ground potential. Accordingly, the gate potential of the PMOS $Q_P2$ falls so that the PMOS $Q_P2$ turns on and, thus, the potential at the node N1 also falls towards the ground potential. As a result, the PMOSs $Q_P1$ and $Q_P3$, the gate terminals of which are connected with the node N1, turn on.

When all of the PMOSs $Q_P1$ through $Q_P3$ and the NMOS $Q_N1$ become conductive states, the potential at the node N1 becomes closer to the ground potential and that at the node N2 becomes closer to the power supply voltage $V_{CC}$ because of the relations to the current capability of the respective transistors concerned. As a result, the PMOS $Q_P2$ turns off, and the potential at the node N1 rises up to $(V_{CC}-V_{TP})$ again and becomes stable there. On the other hand, since the potential at the node N1 is $(V_{CC}-V_{TP})$ and thus the PMOS $Q_P3$ is in a non-conductive state, that is, "off-state", the potential at the node N2 drops towards the ground potential. When this potential at the node N2 drops to the $(V_{CC}-2\times V_{TP})$ or lower, the PMOS $Q_P2$ turns on again. Then, the potential at the node N1 falls again so that the PMOS $Q_P3$ turns on and the potential at the node N2 starts to rise. The potential at the node N2 becomes stable at $(V_{CC}-2\times V_{TP})$ where the PMOS $Q_P2$ eventually turns on.

The potential $(V_{CC}-2\times V_{TP})$ at the node N2 is applied to a gate terminal of the PMOS $Q_P4$. Then, since the voltage across the gate and source terminals of the PMOS $Q_P4$ is $2\times V_{TP}$ regardless of the $V_{CC}$, the PMOS $Q_P4$ operates as a constant-current element. On the other hand, the PMOS $Q_P5$ is always in an conductive state, so that it substantially operates as a resistor (impedance) element, The voltage (hereinafter also referred to as "$V_{REF}$") appearing at the constant-voltage output node $V_{REF}$ becomes substantially constant, so that the circuit shown in FIG. 1 operates as a constant-voltage generating circuit as apparent from the graph shown in FIG. 2.

In recent years, a transistor used in a memory circuit has a tendency of being scaled down owing to the highly integrated memory circuit, and the size of its design rule has almost reached half micron. This gives rise to the problem of a lowering of reliability in the transistor due to hot carriers. This requires that a power supply voltage be reduced. On the other hand, in order to meet user's desires to continue to use the power supply voltage in the same value as is available now in view of its relationship with other products, it has been proposed to adopt an internal voltage dropping circuit which is about to be put in practical use. Such as internal voltage dropping circuit can be designed with the use of the constant-voltage generating circuit described above.

FIG. 3 shows an example of an internal voltage dropping circuit of the kind which is used for the above purpose. In FIG. 3, a reference numeral 1 denotes the constant-voltage generating circuit explained in connection with FIG. 1, symbols $Q_P6$ through $Q_P8$ each denotes a PMOS transistor; $Q_N2$ through $Q_N4$ each denotes an NMOS transistor; N3 denotes an internal node; and $V_{INT}$ denotes an output node for an internal dropped voltage.

The PMOSs $Q_P6$, $Q_P7$ and the NMOSs $Q_N2$ through $Q_N4$ constitute a current-mirror type amplifier which, using as a reference voltage the constant-voltage $V_{REF}$ generated at and forwarded from the constant-voltage generating circuit 1, serves to produce the same potential as the $V_{REF}$ at the internal dropped voltage output node $V_{INT}$. More specifically, in such circuit construction, if the potential at the internal dropped voltage output node $V_{INT}$ falls from the constant-voltage $V_{REF}$, the potential at the node N3 falls by the operation of the amplifier, so that the current supplying capability of the PMOS $Q_P8$ increases. Thus, the potential at the internal output node $V_{INT}$ rises again and returns to the desired constant-voltage. In contrast thereto, if the potential at the internal output node $V_{INT}$ rises from the desired constant-voltage $V_{REF}$, the potential at the node N3 rises by the operation of the amplifier, so that the current supplying capability of the PMOS $Q_P8$ decreases. Thus, the potential at the internal output node $V_{INT}$ falls again and returns to the desired constant-voltage. Accordingly, the constant-voltage with a good response characteristic and sufficient current supplying capability can be provided at the internal dropped voltage output node $V_{INT}$.

The voltage dropping circuit incorporating the conventional constant-voltage generating circuit described above has the following defects.

Generally, in operation, a large current flows through the MOS memory circuit for a short period of time, so that the power supply voltage fluctuates at a time unit of several nanoseconds. On the other hand, as mentioned above, the potentials at the nodes N1 and N2 in the constant-voltage generating circuit are $(V_{CC}-V_{TP})$ and $(V_{CC}-2\times V_{TP})$, respectively, and thus the PMOSs $Q_P1$ through $Q_P3$ are in their conductive states which states are very close to the non-conductive states. In short, the node N1 is in a high impedance state. Therefore, if there occurs a fluctuation in the power supply voltage, the potential at the node N1 transiently shifts to the value which is determined by the ratio between the capacitance of the gates, diffusion layers and wirings connected to the node N1 with respect to the power supply source and the capacitance thereof with respect to the ground GND.

As already described above, since the PMOS Qp3 connected with the node N1 is designed to have a sufficient current supplying capability, the capacitance at the node N1 with respect to the power supply source $V_{CC}$ is larger than the capacitance at the same node N1 with respect to the ground GND. Therefore, when there occurs the above mentioned fluctuation in the power supply voltage, the potential at the node N1 shifts transiently and abruptly towards the power supply voltage $V_{CC}$. As a consequence, the potential at the constant-voltage output node $V_{REF}$ also shifts towards the power supply voltage abruptly. This is a problem to be solved.

SUMMARY OF THE INVENTION

It is, therefore, an object of the present invention to overcome the problems existing in the conventional circuit and to provide an improved constant-voltage generating circuit.

It is another object of the present invention to provide a constant-voltage generating circuit which can generate a highly stabilized constant-voltage regardless of the abrupt fluctuation in the power supply voltage.

According to one aspect of the invention, there is provided a constant-voltage generating circuit which comprises:

a first P-channel MOS transistor having a source connected to a power source line, and a gate and a drain both connected to a first node;

a second P-channel MOS transistor having a source connected to the first node, a gate connected to a second node, and a drain connected to a ground line;

a third P-channel MOS transistor having a source connected to the power source line, a gate connected to the first node, and a drain connected to the second node;

a fourth P-channel MOS transistor having a source connected to the power source line, a gate connected to the second node, and a drain connected to an output terminal;

a current source element connected between the second node and the ground line;

an impedance element connected between the output node and the ground line; and a capacitive element connected between the first node and the ground line for increasing a capacitance therebetween.

According to another aspect of the invention, the constant-voltage generating circuit may further comprise another capacitive element connected between the first node and the power source line for increasing a capacitance therebetween.

The above capacitive element(s) serves to make the ratio of (the total capacitance between the first node and the power source line) to (the total capacitance between the same first node and the ground line) substantially equal to the ratio of (the power supply voltage-the absolute value of the threshold voltage of the P-channel MOS transistor) to (the absolute value of the threshold voltage of the P-channel MOS transistor).

BRIEF DESCRIPTION OF THE DRAWINGS

The above and other objects and features of the present invention will be apparent from the following description taken in conjunction with the accompanying drawings, in which.

DESCRIPTION OF THE PREFERRED EMBODIMENTS

Now, referring to the accompanying drawings, an explanation will be given on the embodiments according to the present invention.

Figure 1:
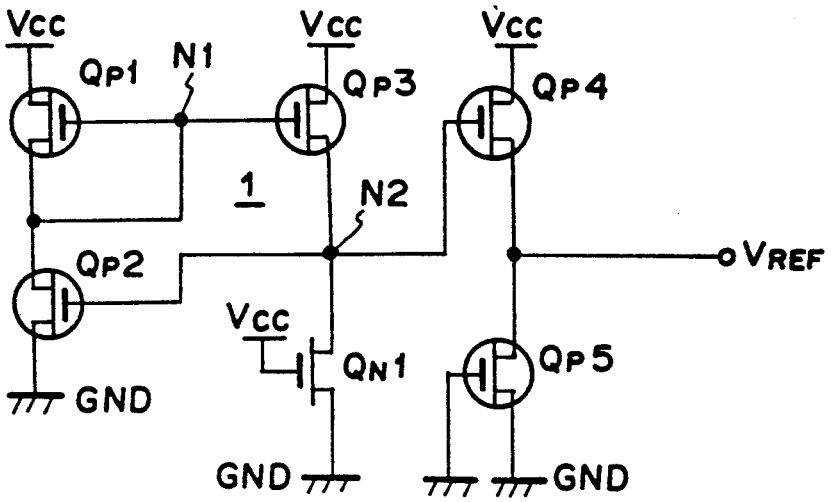
FIG.1 PRIOR ART
FIG. 1 is a circuit diagram showing a conventional constant-voltage generating circuit.
Figure 2:
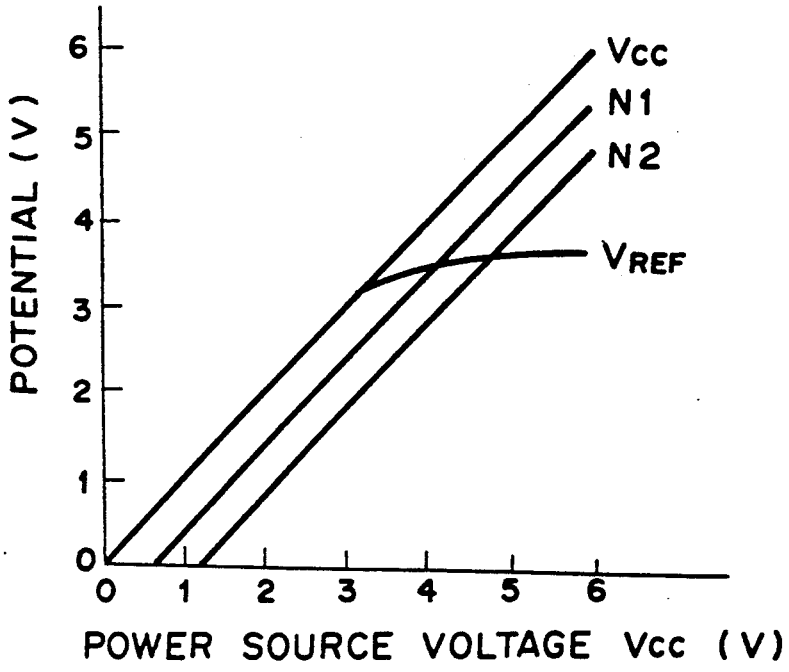
FIG.2 PRIOR ART
FIG. 2 is a graph showing the operation of the circuit shown in FIG. 1.
Figure 3:
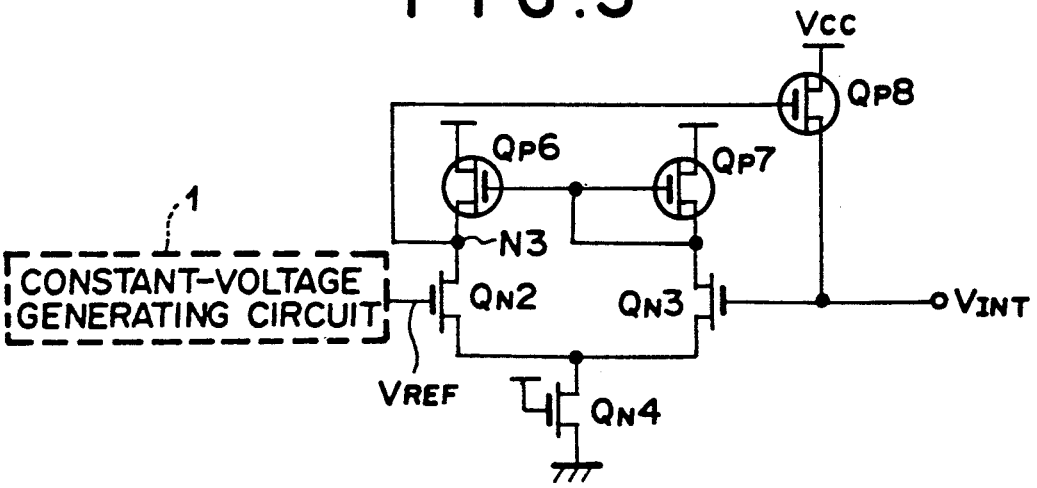
FIG. 3 is a circuit diagram showing an application of the circuit of FIG. 1 to an internal voltage dropping circuit.
Figure 4:
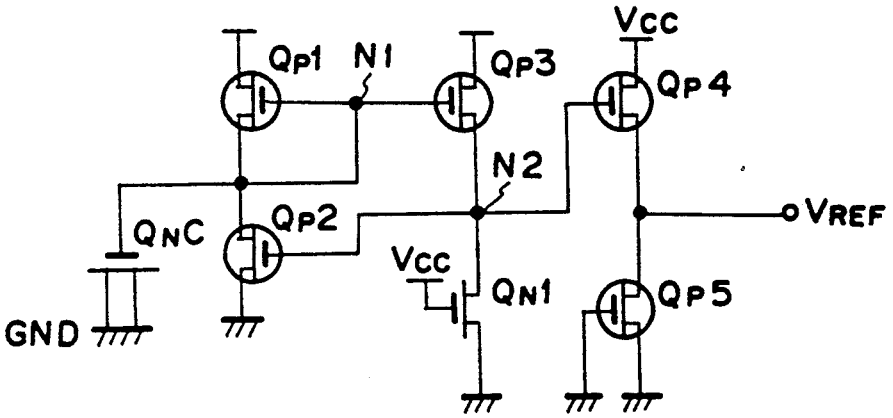
FIG. 4 is a circuit diagram showing one embodiment of a constant-voltage generating circuit according to the invention.

FIG. 4 shows an arrangement of a constant-voltage generating circuit of a first embodiment according to the invention. In FIG. 4, like reference numerals refer to like parts in FIG. 1 showing the conventional circuit. The arrangement of this embodiment is the same as that of the conventional circuit shown in FIG. 1 only except that there is provided an NMOS $Q_NC$ transistor with a gate connected to the node N1, and a source and a drain both connected to the ground GND.

In this embodiment, since the NMOS $Q_NC$ connected between the node N1 and the ground GND is added as a capacitive element to the arrangement of the conventional circuit, the operation of this embodiment in a normal state is the same as that of the conventional circuit.

In this embodiment, the gate size (the gate width and/or the gate length) of the NMOS $Q_NC$ is set for a sufficiently large value, so that a large capacitance with respect to the ground GND is added to the node N1. It should be noted that the amount of potential fluctuation appearing at the node N1 when the potential of the power supply voltage changes abruptly is decided by the ratio between the capacitance at the node N1 with respect to the power supply source and that at the same node N1 with respect to the ground GND. In this embodiment, the capacitance with respect to the ground GND is increased by the provision of the NMOS $Q_NC$, so that the potential fluctuation appearing at the node N1 caused by a possible change in the power source voltage is alleviated.

If the gate size, that is, a gate width and/or a gate length, of the NMOS $Q_NC$ is so adjusted that the ratio of (the capacitance at the node N1 with respect to the power supply source): (that at the node N1 with respect to the ground GND) becomes the ratio of $(V_{CC}-V_{TP})$: $V_{TP}$, a constant-voltage required can be generated more quickly.

Figure 5:
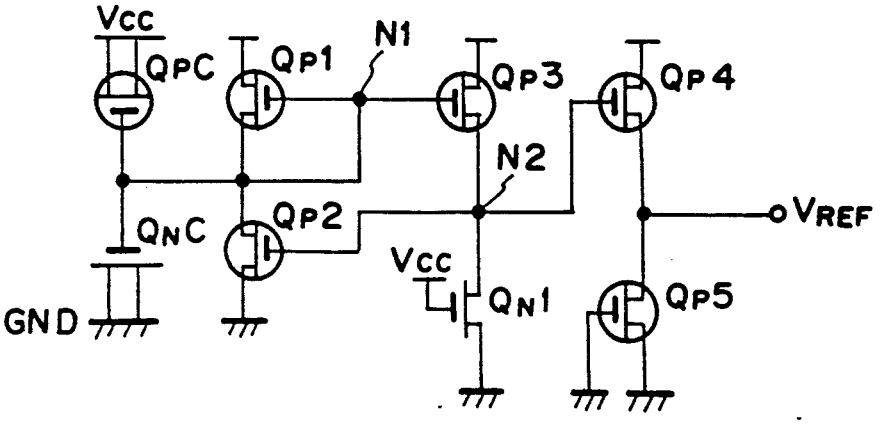
FIG. 5 is a circuit diagram showing another embodiment of a constant-voltage generating circuit according to the invention.

FIG. 5 shows an arrangement of a constant-voltage generating circuit of a second embodiment according to the invention. The arrangement of this embodiment is the same as that of the above explained first embodiment only except that a PMOS transistor $Q_PC$ which functions as another capacitive element and whose gate is connected with the node N1, and whose source and drain are connected with the power supply source $V_{CC}$ is added to the first embodiment shown in FIG. 4.

In this second embodiment, since two transistors $Q_PC$ and $Q_NC$ each serving as a capacitive element are provided, one being connected between the node N1 and the power supply source $V_{CC}$ and the other being connected between the node N1 and the ground GND, the values of these capacitances can be set at any desired values with the ratio between the capacitance at the node N1 with respect to the power supply source and that with respect to the ground GND being maintained constant.

In the above embodiments, although a MOS transistor(s) is used as a capacitive element to be added to the node N1, the present invention should not be limited to it. The capacitor in other forms (e.g., junction capacitor) can be adopted. Further, the NMOS $Q_N1$ serving as a current source may be replaced by a PMOS transistor, and the PMOS $Q_P5$ serving as an impedance element may be replaced by an NMOS transistor.

As has been described hereinabove, in accordance with the present invention, the node having a large capacitance with respect to a power supply source is supplied with a capacitance with respect to the ground, so that the transient voltage fluctuation appearing at the above node caused by the change in the power supply voltage can be effectively suppressed. Therefore, where the constant-voltage generating circuit according to the present invention is used for a voltage dropping circuit for a MOS memory circuit, a highly stabilized constant-voltage can be generated regardless of a possible abrupt change in the power supply voltage caused by a memory activated operation.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A constant-voltage generating circuit comprising:

a first P-channel MOS transistor (Qp1) having a source connected to a power source line (Vcc) and a gate and a drain both connected to a first node (N1);

a second P-channel MOS transistor (Qp2) having a source connected to said first node, a gate connected to a second node, and a drain connected to a ground line;

a third P-channel MOS transistor (Qp3) having a source connected to said power source line, a gate connected to said first node, and a drain connected to said second node;

a fourth P-channel MOS transistor (Qp4) having a source connected to said power source line, a gate connected to said second node, and a drain connected to an output terminal ($V_{REF}$);

a current source element ($Q_N1$) connected between said second node and said ground line; and an impedance element ($Q_P5$) connected between said output node and said ground line; and a first capacitive element ($Q_NC$) connected between said first node and said ground line for increasing capacitance therebetween wherein the total capacitance between the first node and the power source line divided by the total capacitance between the first node and the ground line is substantially equal to the power source voltage minus an absolute value of a threshold voltage of the P-channel MOS transistor divided by the absolute value of the threshold voltage of the P-channel MOS transistor.

2. A constant-voltage generating circuit according to claim 1, in which said first capacitive element is an N-channel MOS transistor having a gate connected to said first node, and a source and a drain both connected to the ground line.

3. A constant-voltage generating circuit according to claim 1, which further comprises a second capacitive element ($Q_PC$) connected between said first node and said power source line for increasing capacitance therebetween.

4. A constant-voltage generating circuit according to claim 3, in which said first capacitive element is an N-channel MOS transistor having a gate connected to said first node, and a source and a drain both connected to the ground line, and said second capacitive elements is a P-channel MOS transistor having a gate connected to said first node, and a source and a drain both connected to said power source line.

5. A constant-voltage generating circuit according to claim 1, in which said first capacitive element is a junction capacitor.

6. A constant-voltage generating circuit according to claim 3, in which said first and second capacitive elements are junction capacitors, respectively.

7. A constant-voltage generating circuit according to claim 1, in which said current source element is an N-channel MOS transistor having a gate connected to said power source line, a drain connected to said second node, and a source connected to said ground line.

8. A constant-voltage generating circuit according to claim 1, in which said impedance element is a P-channel MOS transistor having a source connected to said output terminal, and a gate and a drain both connected to said ground line.

* * * * *